US008770315B2

(12) United States Patent
Takeuchi et al.

(10) Patent No.: US 8,770,315 B2
(45) Date of Patent: Jul. 8, 2014

(54) IMPACT TOOL

(75) Inventors: Hajime Takeuchi, Anjo (JP); Masanori Furusawa, Anjo (JP); Naoki Soeda, Anjo (JP)

(73) Assignee: Makita Corporation, Anjo-shi (JP)

( * ) Notice: Subject to any disclaimer, the term of this patent is extended or adjusted under 35 U.S.C. 154(b) by 528 days.

(21) Appl. No.: 13/110,200

(22) Filed: May 18, 2011

(65) Prior Publication Data

US 2011/0290517 A1 Dec. 1, 2011

(30) Foreign Application Priority Data

May 25, 2010 (JP) ..... 2010-119707

(51) Int. Cl.
*B25D 17/08* (2006.01)

(52) U.S. Cl.
USPC ..... 173/210; 173/217; 173/162.2; 173/48

(58) Field of Classification Search
USPC ..... 173/210, 217, 162.2, 48; 279/19.4, 9.1, 279/90
See application file for complete search history.

(56) References Cited

U.S. PATENT DOCUMENTS

| | | | | |
|---|---|---|---|---|
| 5,127,764 | A | 7/1992 | Baer | |
| 5,344,380 | A | 9/1994 | Chern et al. | |
| 2001/0017447 | A1 * | 8/2001 | Baumann et al. | 279/19.4 |
| 2003/0089509 | A1 | 5/2003 | Wanek et al. | |

FOREIGN PATENT DOCUMENTS

| | | | |
|---|---|---|---|
| DE | 44 36 860 | A1 | 4/1996 |
| GB | 2 294 220 | A | 4/1996 |
| GB | 2 333 980 | A | 8/1999 |
| JP | A-7-501747 | | 2/1995 |
| JP | A-2006-159376 | | 6/2006 |
| WO | WO 03/022531 | A1 | 3/2003 |

OTHER PUBLICATIONS

Search Report issued in European Patent Application No. 11 167 227.0 dated Jun. 18, 2012.
Nov. 19, 2013 Office Action issued in Japanese Patent Application No. 2010-119707.
Aug. 30, 2011 European Search Report issued in European Application No. EP 11 16 7277.

* cited by examiner

*Primary Examiner* — Michelle Lopez
(74) *Attorney, Agent, or Firm* — Oliff PLC

(57) ABSTRACT

An impact tool includes a bit holding device with an elongate tool holder having a bit holding hole with a tool bit, an outer shell component forming an outer shell of the bit holding device and mounted onto a front end portion of the tool holder, a stopper fitted onto the tool holder and prevented from moving in a longitudinal direction of the tool holder, and prevents the outer shell component from becoming detached from the front end of the tool holder, and an opening prevention member disposed outward of a center position of the stopper in the longitudinal direction of the tool holder and opposed to an outer surface of the stopper in a direction transverse to the longitudinal direction of the tool holder, and prevents the stopper from opening in the direction transverse to the longitudinal direction of the tool holder.

5 Claims, 4 Drawing Sheets

IMPACT TOOL

BACKGROUND OF THE INVENTION

1. Field of the Invention

The invention relates to an impact tool that performs a predetermined operation on a workpiece at least by a linear movement of a tool bit in an axial direction.

2. Description of the Related Art

Japanese non-examined laid-open Patent Publication No. 2006-159376 discloses an impact tool in which a bit holding device is mounted onto a front end portion of a tool holder and holds the hammer bit inserted into the tool holder. In the bit holding device, a cylindrical outer shell component forms an outer shell of the bit holding device and is fitted onto the tool holder into which the hammer bit is inserted so as to cover the front end portion of the tool holder. Further, a stopper in the form of a ring spring is fitted on the tool holder and prevents the outer shell component from slipping out of the tool holder.

In the above-described known construction, the ring spring may open by impact caused by idle driving of the impact tool (when the impact tool is driven in a state in which the hammer bit is not pressed against the workpiece). If such occurs repeatedly, the ring spring may be worn and damaged. Therefore, in the above-described impact tool, load is applied to the outer shell component in its axial direction by using a tool specifically designed for this purpose, so that a ring-like cushioning material (rubber) disposed within the outer shell component is compressively deformed. In this state, a metal washer and then a ring spring are fitted onto the tool holder, and an inner tapered surface of the washer is held in contact with the ring spring.

In this manner, the ring spring is fixed such that it is prevented from opening in the radial direction. Such a structure needs cumbersome assembling and it is not rational as an opening prevention structure for the ring spring. In this point, further improvement is required.

SUMMARY OF THE INVENTION

Accordingly, it is an object of the invention to provide an effective technique for preventing opening of a stopper in an impact tool having a bit holding device where a stopper is provided to prevent an outer shell component of the bit holding device from becoming detached from the tool holder.

Above described object is achieved by the claimed invention. According to the invention, a representative impact tool includes a tool body and a bit holding device mounted onto a front end region of the tool body to perform a predetermined operation at least by linearly driving a tool bit held by the bit holding device. The bit holding device has a tool holder, an outer shell component, a stopper and an opening prevention member. The tool holder is an elongate member having a bit holding hole into which the tool bit is removably inserted. The outer shell component is mounted onto a front end portion of the tool holder by moving it from the front end of the tool holder toward the tool body. The stopper is fitted onto the tool holder such that it is prevented from moving in a longitudinal direction of the tool holder, and serves to prevent the outer shell component from becoming detached from the front end of the tool holder. The stopper typically comprises a stopper ring such as a C-ring and an E-ring. Here, the manner of being fitted such that "the stopper is prevented from moving in a longitudinal direction" represents the manner in which an annular groove is formed around the tool holder in the circumferential direction and the stopper is fitted in this annular groove. The opening prevention member is disposed outward of a center position of the stopper in the longitudinal direction of the tool holder and opposed to an outer surface of the stopper in a direction transverse to the longitudinal direction of the tool holder. The opening prevention member prevents the stopper from opening in the direction transverse to the longitudinal direction of the tool holder by impact which is transmitted from the tool holder to the stopper during idle driving. Further, the "idle driving" represents the manner of driving the impact tool in the state in which the tool bit is not pressed against the workpiece.

According to the invention, by provision of the construction in which the opening prevention member is disposed outward of a center position of the stopper in the longitudinal direction of the tool holder and opposed to an outer surface of the stopper in a direction transverse to the longitudinal direction of the tool holder, when the impact caused by idle driving acts upon the stopper, which may cause the stopper to open in the direction transverse to the longitudinal direction of the tool holder, the opening prevention member can prevent the stopper from opening. Therefore, wear of the stopper which may be caused by repeated opening movement can be reduced, so that durability can be improved.

According to a further aspect of the invention, the stopper and the opening prevention member are normally disposed in non-contact with each other.

With such a construction, manufacturing requirements can be relaxed in the relationship between the stopper and the opening prevention member.

According to a further aspect of the invention, the tool holder has a protruding front end which protrudes from a front end of the outer shell component. The bit holding device has a rubber covering fitted onto the protruding front end. The opening prevention member is integrated with the covering and disposed outward of the stopper when the covering is fitted onto the protruding front end of the tool holder.

In the state in which the outer shell component mounted onto the front end portion of the tool holder is prevented from slipping off by the stopper, simply by fitting the covering onto the protruding front end of the tool holder, the stopper can be prevented from opening by the opening prevention member. Therefore, ease of assembling and repairing can be enhanced.

According to a further aspect of the invention, the opening prevention member is made of metal.

By provision of the metal opening prevention member, a predetermined resistance can be provided to opening of the stopper.

According to the invention, an effective technique for rationally preventing opening of a stopper is provided in an impact tool having a bit holding device in which a stopper is provided to prevent an outer shell component of the bit holding device from becoming detached from the tool holder. Other objects, features and advantages of the present invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide and manufacture improved impact tools and method for using such impact tools and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

Figure 1:
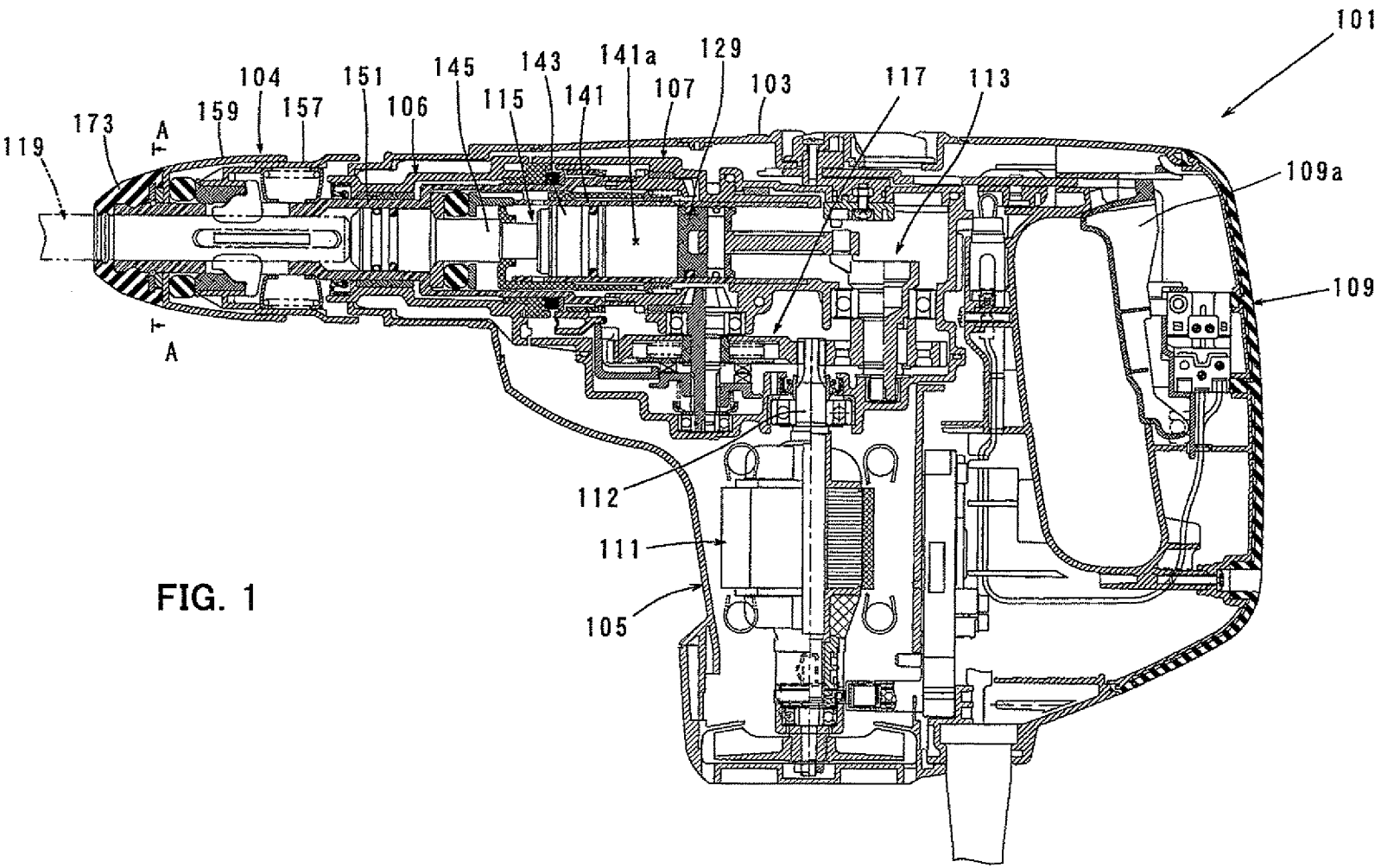
FIG. 1 is a sectional side view showing an entire hammer drill according to an embodiment of the invention.

An embodiment according to the invention is now described with reference to FIGS. 1 to 4. In this embodiment, an electric hammer drill is explained as a representative example of an impact tool according to the invention. As shown in FIG. 1, a hammer drill 101 mainly includes a body 103 that forms an outer shell of the hammer drill 101, a bit holding device 104 provided in a front (left as viewed in FIG. 1) end region of the body 103 and a handgrip 109 that is mounted to a rear (right as viewed in FIG. 1) end of the body 103 and designed to be held by a user during operation. A hammer bit 119 is mounted to the bit holding device 104 such that it can move in its axial direction with respect to the bit holding device and rotates together with the bit holding device in its circumferential direction. The body 103 and the hammer bit 119 are features that correspond to the "tool body" and the "tool bit", respectively, in this invention. Further, for the sake of convenience of explanation, the hammer bit 119 side is taken as the front, and the handgrip 109 side as the rear.

The body 103 mainly includes a motor housing 105 that houses a driving motor 111, and a gear housing 107 that houses a motion converting mechanism 113, a striking mechanism 115 and a power transmitting mechanism 117. A rotating output of the driving motor 111 is appropriately converted into linear motion by the motion converting mechanism 113 and then transmitted to the striking mechanism 115. As a result, an impact force is generated in the axial direction of the hammer bit 119 (the horizontal direction as viewed in FIG. 1) via the striking mechanism 115. Further, the speed of the rotating output of the driving motor 111 is appropriately reduced by the power transmitting mechanism 117 and then transmitted to the hammer bit 119. As a result, the hammer bit 119 is caused to rotate in its circumferential direction. The driving motor 111 is disposed below the axis of the hammer bit 119 such that an extension of an axis of an output shaft 112 intersects with the axis (extends transversely to the axial direction) of the hammer bit 119. Further, the driving motor 111 is driven when a user depresses a trigger 109*a* disposed on the handgrip 109.

The motion converting mechanism 113 mainly includes a crank mechanism. The crank mechanism is constructed such that a driving element in the form of a piston 129 forming a final movable member of the crank mechanism linearly moves in the axial direction of the hammer bit within a cylinder 141 when the crank mechanism is rotationally driven by the driving motor 111. The power transmitting mechanism 117 mainly includes a gear speed reducing mechanism comprising a plurality of gears. The power transmitting mechanism 117 appropriately reduces the speed of the rotating output of the driving motor 111 and then transmits it to the hammer bit 119 via a tool holder 151 forming a final axis, so that the power transmitting mechanism 117 causes the hammer bit 119 to rotate in its circumferential direction.

The striking mechanism 115 mainly includes a striking element in the form of a striker 143 that is slidably disposed within a bore of the cylinder 141 together with the piston 129, and an intermediate element in the form of an impact bolt 145 that is slidably disposed within the tool holder 151 which is described below. The striker 143 is driven via an air spring action (pressure fluctuations) of an air chamber 141*a* of the cylinder 141 by sliding movement of the piston 129 and collides with (strikes) the impact bolt 145. The striker 143 then transmits a striking force caused by the collision to the hammer bit 119 via the impact bolt 145.

In the hammer drill 101 constructed as described above, when the driving motor 111 is driven, a striking force is applied to the hammer bit 119 in the axial direction from the motion converting mechanism 113 via the striking mechanism 115, and a rotating force is applied to the hammer bit 119 in the circumferential direction via the power transmitting mechanism 117. Thus, the hammer bit 119 held by the bit holding device 104 performs a hammering movement in the axial direction and a drilling movement in the circumferential direction, so that a hammer drill operation (drilling) is performed on a workpiece (concrete) which is not shown. Further, the hammer drill 101 can be appropriately switched between mode of hammer drill operation by hammering movement and drilling movement in the circumferential direction as described above and mode of hammering operation in which only a striking force in the axial direction is applied to the hammer bit 119. However, this is not directly related to the invention, and therefore its detailed description is omitted.

The bit holding device 104 for holding the hammer bit 119 is now explained with reference to FIGS. 2 to 4. The bit holding device 104 mainly includes the cylindrical tool holder 151 having a bit holding hole 151*a* which is circular in section and into which the hammer bit 119 is removably inserted, a plurality of engagement claws 155 that prevent or allow removal of the hammer bit 119 inserted into the bit holding hole 151*a*, a tool sleeve 157 that is operated by the user and serves to switch the engagement claws 155 between a removal preventing position and a removal allowing position for the hammer bit 119, a generally cylindrical dust-resistant covering 159 that covers a front region of the tool sleeve 157, and a rubber cap 173 that is disposed in front of the covering 159.

The tool holder 151 is an elongate member extending within a generally cylindrical barrel 106 which forms a front region (front end region) of the gear housing 107 and is caused to rotate via the above-described power transmitting mechanism 117. A torque transmission groove 119*a* is formed in an outer periphery of the shank of the hammer bit 119, and when the hammer bit 119 is inserted into the bit holding hole 151*a* of the tool holder 151, the torque transmission groove 119*a* is engaged with a plurality of torque transmitting parts in the form of projections 153 which protrude radially inward from the tool holder 151 into the bit holding hole 151*a*, so that the hammer bit 119 receives a rotating force from the tool holder 151.

A plurality of elongate holes 152 are formed through the tool holder 151 in the radial direction and extend to a predetermined length in the axial direction, and the holes 152 are arranged at predetermined intervals in the circumferential direction. Engagement claws 155 are disposed in the elongate holes 152 and can move in the axial direction and the radial direction of the tool holder 151. When the hammer bit 119 is inserted into the bit holding hole 151*a*, an inner end of each of the engagement claws 155 in the radial direction of the tool holder 151 is fitted in an engagement groove (not shown) formed in the outer periphery of the shank of the hammer bit 119. In this manner, the engagement claws 155 prevent removal of the hammer bit 119 from the bit holding hole 151*a*.

The tool sleeve 157 is disposed outside of the tool holder 151 such that it can move in the axial direction of the tool holder 151 (in the back-and-forth direction). Further, the tool sleeve 157 has a cylindrical portion 157*a* which is formed on its front end in the axial direction and slidably fitted onto a cam ring 156. The tool sleeve 157 further has a spring receiving disk 163 which is disposed at the rear of the cylindrical portion 157*a* and receives a compression coil spring 161. An outer protruding end 155*a* of the engagement claw 155 is held between the cylindrical portion 157*a* and the spring receiving disk 163 from the front and the rear. Therefore, when the tool sleeve 157 is moved forward or rearward, the outer protruding end 155*a* of the engagement claw 155 is pushed by the spring receiving disk 163 or the cylindrical portion 157*a*, so that the engagement claw 155 is also moved forward or rearward. Further, the cam ring 156 is fitted onto the tool holder 151 such that it can slide in the axial direction of the tool holder.

The tool sleeve 157 is constantly biased forward (toward the front end) by a biasing member in the form of a compression coil spring 161 which is disposed between the tool sleeve 157 and the tool holder 151. Specifically, the compression coil spring 161 is disposed between the spring receiving disk 163 on the tool sleeve 157 side and a spring receiving disk 163 on the tool holder 151 side, and applies a spring force on the tool sleeve 157 in the axially forward direction. In the state in which the hammer bit 119 is not inserted into the bit holding hole 151*a*, the tool sleeve 157 which is acted upon by the biasing force of the compression coil spring 161 is pushed forward and its axial front end of the tool sleeve 157 comes in contact with a stopper in the form of a flange 156*a* formed around the cam ring 156. As a result, the tool sleeve 157 is held in a forward position.

When the tool sleeve 157 is placed in the forward position, the engagement claw 155 is prevented from moving radially outward by the cam ring 156 and thus prevents removal of the hammer bit 119 from the tool holder 151. On the other hand, when the tool sleeve 157 is moved rearward against the biasing force of the compression coil spring 161, the engagement claw 155 moves radially outward while moving rearward and allows removal of the hammer bit 119 from the tool holder 151. Such s construction is well known in the art and therefore their detailed description is omitted.

The generally cylindrical dust-resistant covering 159 is disposed on a front region of the tool sleeve 157. The dust-resistant covering 159 covers the front region of the tool sleeve 157, excluding a region necessary to be operated by user's fingers, so that dust can be prevented from entering the bit holding device 104. The dust-resistant covering 159 forms an outer shell of the bit holding device 104 and is a feature that corresponds to the "outer shell component" in this invention. The dust-resistant covering 159 for covering the tool sleeve 157 has a flange 159*a* extending radially inward from its front end, and the inward flange 159*a* is slidably fitted on the outer surface of the tool holder 151. A ring-like cushioning 167 is disposed between the inward flange 159*a* and the cam ring 156, and further a metal washer 169 is disposed in front of the inward flange 159*a*. The cushioning 167 and the washer 169 are loosely fitted onto the outer surface of the tool holder 151.

The tool sleeve 157, the cam ring 156, the cushioning 167, the dust-resistant covering 159 and the washer 169 are fitted onto the tool holder 151 from the front in this order. In this manner, these members are mounted to the tool holder 151 such that axial end surfaces of the adjacent members are held in contact with each other. Further, these members are prevented from slipping off by a stopper ring 171 such as a C-ring and an E-ring formed of a wire rod having a circular section. Therefore, the forward biasing force of the compression coil spring 161 acts on the washer 169 via the tool sleeve 157, the cushioning 167 and the dust-resistant covering 159 and is finally received by the stopper ring 171. The stopper ring 171 is elastically fitted in an annular groove 151*b* which is formed in the outer surface of the tool holder 151 in the circumferential direction and has a generally semi-circular section, so that it is mounted on the outer surface of the tool holder 151 in such a manner as to be prevented from moving in the axial direction.

Figure 3:
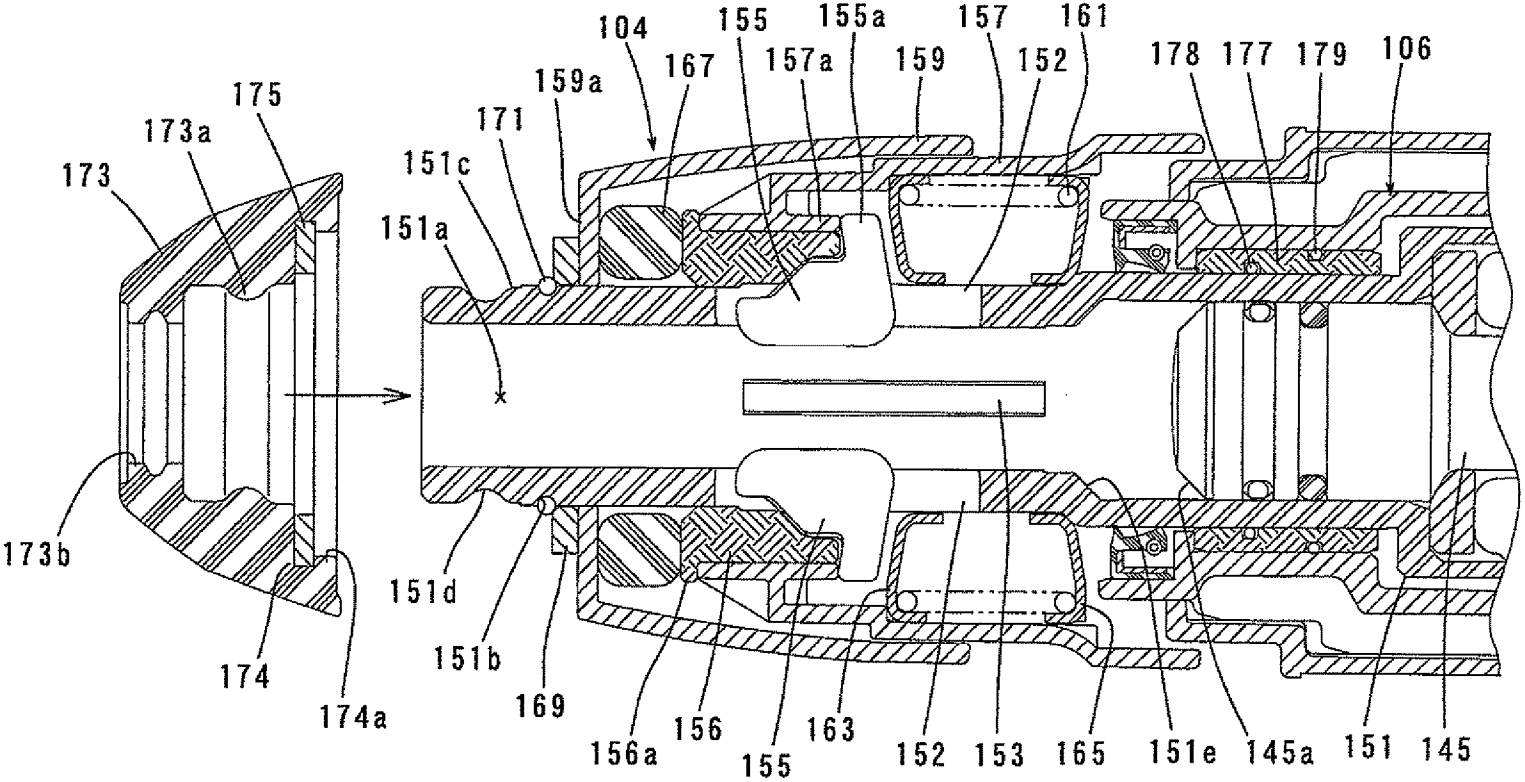
FIG. 3 illustrates a manner of mounting a cap of a chuck device.
Figure 4:
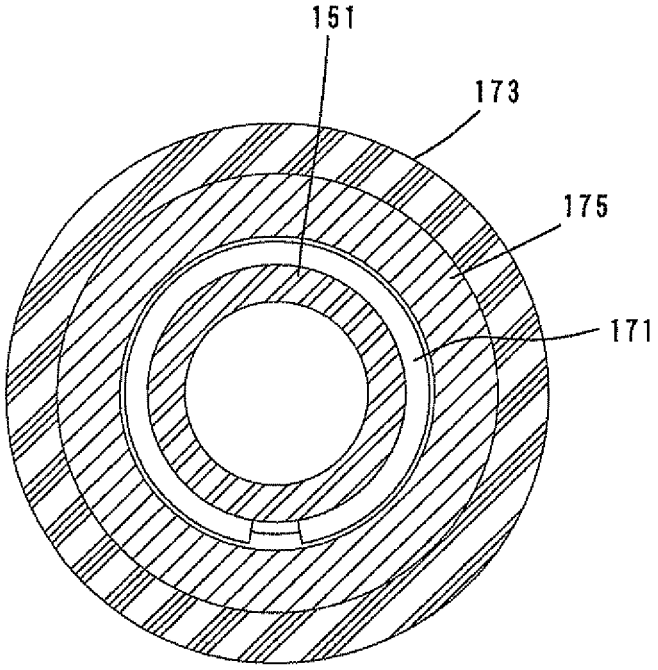
FIG. 4 is an enlarged sectional view taken along line A-A in FIG. 1.

As shown in FIG. 3, the front end of the tool holder 151 protrudes forward from the front surface of the dust-resistant covering 159, and the rubber cap 173 is fitted onto a protruding front end 151*c* in such a manner as to cover the protruding front end 151*c* from the outside. The cap 173 is a feature that corresponds to the "covering" in this invention. Further, a metal opening prevention ring 175 is disposed inside of a rear end of the cap 173 and serves to prevent the stopper ring 171 from opening in the radial direction of the stopper ring 171 or in a direction transverse to the longitudinal direction of the tool holder 151. The opening prevention ring 175 is a ring closed in its circumferential direction and formed of a rigid wire rod such as steel which has a rectangular section having a longer length in the radial direction of the ring than its thickness (length in the axial direction). Further, the opening prevention ring 175 is disposed outward of a center position of the stopper ring 171 in the longitudinal direction of the tool holder 151 such that its inner surface is opposed to the outer surface of the stopper ring 171 in non-contact with each other with a clearance therebetween. The opening prevention ring 175 is a feature that corresponds to the "opening prevention member" in this invention.

The cap 173 is a cylindrical member having its front and rear open ends and mounted to the tool holder 151 by fitting it onto the outer surface of the protruding front end 151*c* of the tool holder 151 from the front. The cap 173 has a lip-like protruding piece 173*b* formed on an inner surface of its front end, and the protruding piece 173*h* is elastically held in contact with the outer periphery of the shank of the hammer bit 119 inserted into the bit holding hole 151*a*. In this manner, the cap 173 mounted onto the tool holder 151 prevents dust from entering the bit holding device 104 through a clearance between the outer surface of the hammer bit 119 and the inner surface of the cap 173. Further, a projection 173*a* is formed on a middle portion of a bore inner surface of the cap 173 in the axial direction and protrudes radially inward. When the cap 173 is mounted onto the protruding front end 151*c* of the tool holder 151, the projection 173*a* is elastically engaged with an annular recess 151*d* formed in the outer surface of the protruding front end 151*c*, so that the cap 173 is held in the mounted state. However, when the cap 173 is pulled forward by a force strong enough to elastically deform the projection 173*a* for the purpose of maintenance or repair, the cap 173 can be removed from the protruding front end 151*c* of the tool holder 151.

As shown in FIG. 3, the opening prevention ring 175 is fitted into a ring holding portion 174 formed in the vicinity of the rear opening of the cap 173 from the rear, and an outer edge of a rear end surface of the opening prevention ring 175 is supported by an inward flange 174*a* of the ring holding portion 174. Thus, the opening prevention ring 175 is integrated with the cap 173. When the cap 173 is fitted onto a normal position on the protruding front end 151*c* of the tool holder 151, as shown in FIG. 2, the inner surface of the opening prevention ring 175 is opposed to the outer surface of the stopper ring 171 in non-contact therewith.

Figure 2:
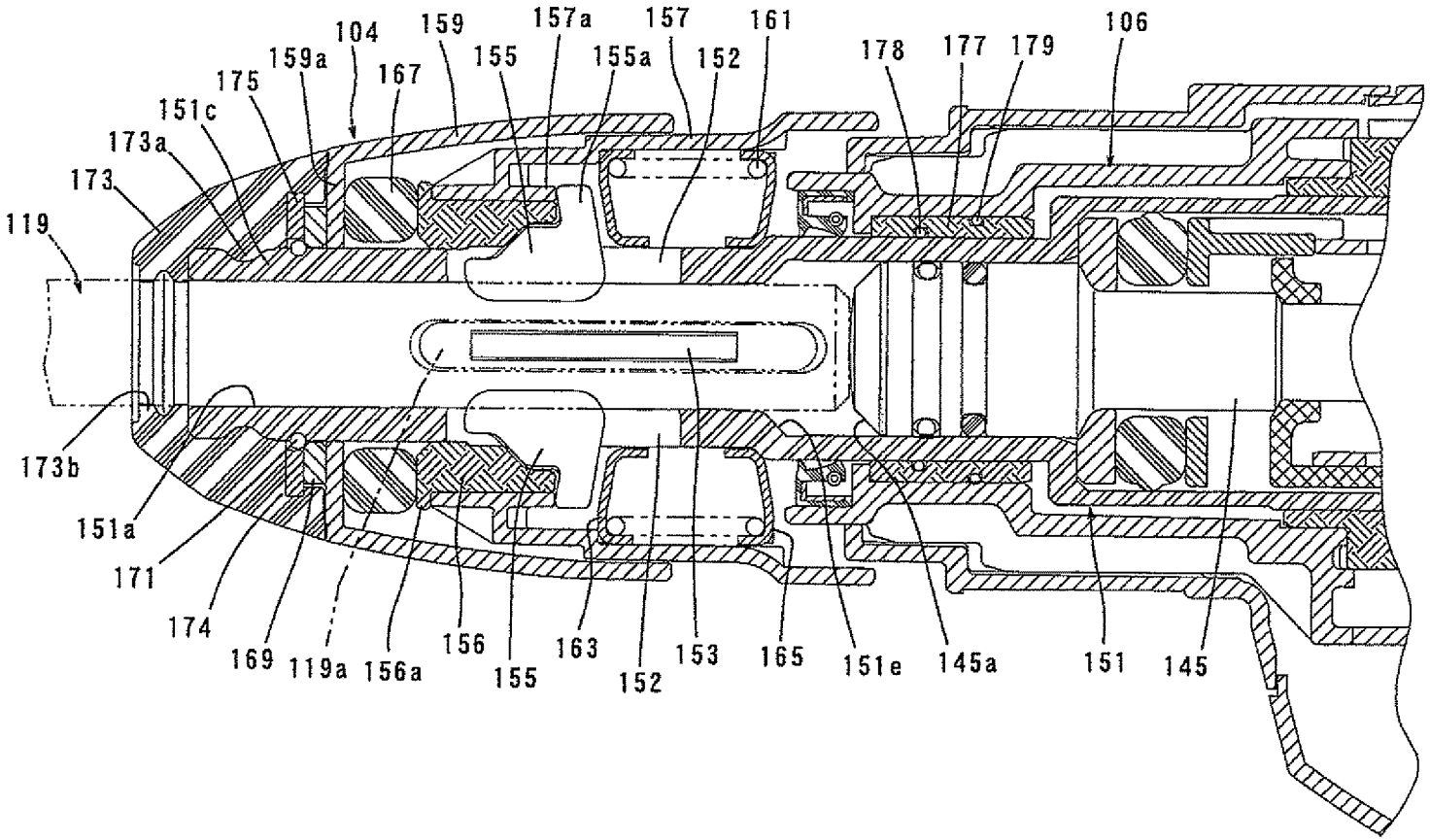
FIG. 2 is an enlarged sectional view showing an essential part of the hammer drill.

Further, as shown in FIGS. 2 and 3, a metal (bearing) 177 is disposed between a region of the tool holder 151 which houses the impact bolt 145, and the cylindrical barrel 106 forming the front end region of the gear housing 107, so that the tool holder 151 is rotatably supported. An O-ring 179 is disposed between an outer circumferential surface of the metal 177 and an inner circumferential surface of the barrel 106, and an O-ring 178 is disposed between an inner circumferential surface of the metal 177 and an outer circumferential surface of the tool holder 151. The outer O-ring 179 which is disposed between the outer circumferential surface of the metal 177 and the inner circumferential surface of the barrel 106 serves to prevent the metal 177 from rotating with respect to the barrel 106, so that a sliding surface is provided between the metal 177 and the tool holder 151. Therefore, lubricant (grease) within the gear housing may leak to the outside through the sliding surface or clearance between the inner circumferential surface of the metal 177 and the outer circumferential surface of the tool holder 151. In this embodiment, the O-ring 178 is provided between the inner circumferential surface of the metal 177 and the outer circumferential surface of the tool holder 151, so that lubricant is prevented from leaking to the outside. Further, naturally, the outer O-ring 179 has a sealing function for preventing leakage of the lubricant.

The bit holding device 104 according to this embodiment is constructed as described above. When the shank of the hammer bit 119 is inserted into the bit holding hole 151*a* of the tool holder 151, removal of the hammer bit 119 from the tool holder 151 is prevented by the engagement claws 155. Further, in this removal prevented state, the hammer bit 119 is held by the tool holder 151 such that it can move in the axial direction with respect to the tool holder 151 and can rotate in the circumferential direction together with the tool holder 151 by engagement of the projection 153 with the torque transmission groove 119*a*. Therefore, the hammer bit 119 can perform hammering movement by being struck by the impact bolt 145 and drilling movement by rotating together with the tool holder 151.

When the hammer drill 101 is driven at idle or driven in the state in which the hammer bit 119 is not pressed against the workpiece, the striker 143 strikes the impact bolt 145 and a front end tapered surface 145*a* of the impact bolt 145 comes in contact with a tapered surface 151*e* of an inner wall of the tool holder 151. At this time, by the impact of this contact, the stopper ring 171 may open radially outward. In this embodiment, the opening prevention ring 175 is disposed on the outside of the stopper ring 171. Therefore, when the impact of idle driving acts upon the stopper ring 171, which may cause the stopper ring 171 to open radially outward, the outer surface of the stopper ring 171 comes in contact with the inner surface of the opening prevention ring 175, so that the stopper ring 171 is prevented from opening. Specifically, according to this embodiment, the opening prevention ring 175 can prevent the stopper ring 171 from opening, so that wear which may be caused by repeated opening movement of the stopper ring 171 can be reduced and durability can be enhanced. In this embodiment, the opening prevention ring 175 has a rectangular section and serves to prevent opening of the stopper ring 171 by its side extending in a direction transverse to its radial direction, so that it can perform the function of preventing opening of the stopper ring 171 with stability.

Further, in this embodiment, the opening prevention ring 175 is fitted in the ring holding portion 174 of the cap 173 and the outer edge of the rear end surface of the opening prevention ring 175 is supported by the inward flange 174*a*, so that the opening prevention ring 175 is integrated with the cap 173. With such a construction, when the cap 173 is mounted by fitting onto the protruding front end 151*c* of the tool holder 151, simultaneously, the opening prevention ring 175 can be easily disposed on the outside of the stopper ring 171. Therefore, ease of assembling and repairing can be enhanced.

Further, in this embodiment, the opening prevention ring 175 is disposed on the outside of the stopper ring 171 in non-contact therewith. Therefore, it is allowed to relax the manufacturing accuracy of the stopper ring 171 and the opening prevention ring 175, so that the manufacturing costs can be reduced. Further, by provision of the metal opening prevention ring 175, sufficient resistance (strength) to radial opening of the stopper ring 171 can be easily ensured.

Further, in this embodiment, the opening prevention ring 175 is integrated with the cap 173, but it may be constructed such that the opening prevention ring 175 and the cap 173 are separately assembled. Further, it may be constructed such that the inner surface of the opening prevention ring 175 is held in contact with the outer surface of the stopper ring 171 under normal conditions (in which no impact is applied).

Further, in the above-described embodiment, the hammer drill 101 is described in which the hammer bit 119 performs a hammering movement in the axial direction and a drilling movement in the circumferential direction, but naturally, the invention can also be applied to a hammer drill in which the hammer bit 119 performs only a hammering movement in the axial direction.

DESCRIPTION OF NUMERALS

101 electric hammer (impact tool)
103 body (tool body)
104 bit holding device
105 motor housing
106 barrel
107 gear housing
109 handgrip
109*a* trigger
111 driving motor
112 output shaft
113 motion converting mechanism
115 striking mechanism
117 power transmitting mechanism
119 hammer bit (tool bit)
119*a* torque transmission groove
129 piston
141 cylinder
141*a* air chamber
143 striker
145 impact bolt
145*a* tapered surface
151 tool holder
151*a* bit holding hole
151*b* annular groove

151*c* protruding front end
151*d* recess
151*e* tapered surface
152 elongate hole
153 projection
155 engagement claw
155*a* outer protruding end
156 cam ring
156*a* flange
157 tool sleeve
157*a* cylindrical portion
159 dust-resistant covering (outer shell component)
159*a* inward flange
161 compression coil spring
163 spring receiving disk
165 spring receiving disk
167 cushioning
169 washer
171 stopper ring
173 cap (covering)
174 ring holding portion
174*a* inward flange
175 opening prevention ring (opening prevention member)
177 metal
178, 179 O-ring

What we claim is:

1. An impact tool comprising a tool body and a bit holding device mounted onto a front end region of the tool body to perform a predetermined operation at least by linearly driving a tool bit held by the bit holding device, wherein the bit holding device comprises:

an elongate tool holder having a bit holding hole into which the tool bit is removably inserted, an outer shell component which forms an outer shell of the bit holding device and is mounted onto a front end portion of the tool holder by moving the outer shell component from the front end of the tool holder toward the tool body, a stopper which is fitted onto the tool holder such that the stopper is prevented from moving in a longitudinal direction of the tool holder, and serves to prevent the outer shell component from slipping out of the front end of the tool holder, and an opening prevention member which is disposed outward of a center position of the stopper in the longitudinal direction of the tool holder and opposed to an outer surface of the stopper in a direction transverse to the longitudinal direction of the tool holder, and is configured to prevent the stopper from opening in the direction transverse to the longitudinal direction of the tool holder when impact is transmitted from the tool holder to the stopper during idle driving, wherein the stopper and the opening prevention member are normally disposed in non-contact with each other.

2. The impact tool as defined in claim 1, wherein the tool holder has a protruding front end which protrudes from a front end of the outer shell component, the bit holding device further has a rubber covering fitted onto the protruding front end, and the opening prevention member is integrated with the covering and disposed outward of the stopper when the covering is fitted onto the protruding front end of the tool holder.

3. The impact tool as defined in claim 1, wherein the opening prevention member is made of metal.

4. The impact tool as defined in claim 1, wherein the opening prevention member is formed by a ring closed in a circumferential direction.

5. The impact tool as defined in claim 4, wherein the ring has a rectangular section, and its inner circumferential surface transverse to a direction transverse to the longitudinal direction of the tool holder is opposed to an outer surface of the stopper.

* * * * *